US009230719B2

(12) United States Patent
Feichtinger et al.

(10) Patent No.: US 9,230,719 B2
(45) Date of Patent: Jan. 5, 2016

(54) METHOD FOR PRODUCING AN ELECTRICAL COMPONENT, AND ELECTRICAL COMPONENT

(75) Inventors: Thomas Feichtinger, Graz (AT); Sebastian Brunner, Graz (AT)

(73) Assignee: EPCOS AG, Munich (DE)

( * ) Notice: Subject to any disclaimer, the term of this patent is extended or adjusted under 35 U.S.C. 154(b) by 0 days.

(21) Appl. No.: 14/235,776

(22) PCT Filed: Jul. 26, 2012

(86) PCT No.: PCT/EP2012/064726

§ 371 (c)(1), (2), (4) Date: Apr. 25, 2014

(87) PCT Pub. No.: WO2013/017531

PCT Pub. Date: Feb. 7, 2013

(65) Prior Publication Data

US 2014/0225710 A1 Aug. 14, 2014

(30) Foreign Application Priority Data

Jul. 29, 2011 (DE) ..... 10 2011 109 007

(51) Int. Cl.
*H01C 7/10* (2006.01)
*H01C 7/13* (2006.01)
(Continued)

(52) U.S. Cl.
CPC ..... *H01C 7/008* (2013.01); *H01C 7/041* (2013.01); *H01C 7/12* (2013.01); *H01C 7/18* (2013.01); *H01C 17/00* (2013.01); *Y10T 29/49085* (2015.01)

(58) Field of Classification Search
CPC ..... H01C 7/008; H01C 7/04; H01C 7/18; H01C 17/06533; H01C 7/041; H01C 7/043; H01C 1/1413; H01C 17/00; H01C 7/021; H01C 7/042; H01C 17/06; H01C 1/1406; H01C 1/142; H01C 7/045; H01C 7/06; H01C 13/02; H01C 17/06546; H01C 17/20; H01C 1/012; H01C 1/14; H01C 1/144; H01C 1/148; H01C 1/16; H01C 7/02; H01C 7/044; H01C 7/12
USPC ..... 338/22 R, 22 SD, 21
See application file for complete search history.

(56) References Cited

U.S. PATENT DOCUMENTS 3,568,125 A * 3/1971 Villemant et al. ..... 338/22 R
4,200,970 A * 5/1980 Schonberger ..... 29/593
(Continued)

FOREIGN PATENT DOCUMENTS

DE 19835443 A1 3/1999
EP 2472529 A1 7/2012
(Continued)

*Primary Examiner* — Kyung Lee
(74) *Attorney, Agent, or Firm* — McDermott Will & Emery LLP

(57) ABSTRACT

A method for producing an electrical component, comprises providing a ceramic semiconducting base body (10) having a surface (O10) and a first side area (S10*a*) lying opposite the surface (O10), wherein a metallic layer (40) is contained within the base body. After at least two further metallic layers (210) have been arranged separately from one another on the side area (S10*a*) of the base body, the arrangement is sintered. An electrically insulating layer (30) is arranged between the at least two further metallic layers (210). A respective contact layer (220) is arranged on the metallic layers (210) by means of a chemical process. In this case, the material of the base body (10) is removed proceeding from the surface (O10) of the base body (10) at most as far as the metallic layer (40) arranged within the base body.

15 Claims, 5 Drawing Sheets

Figure 1A:
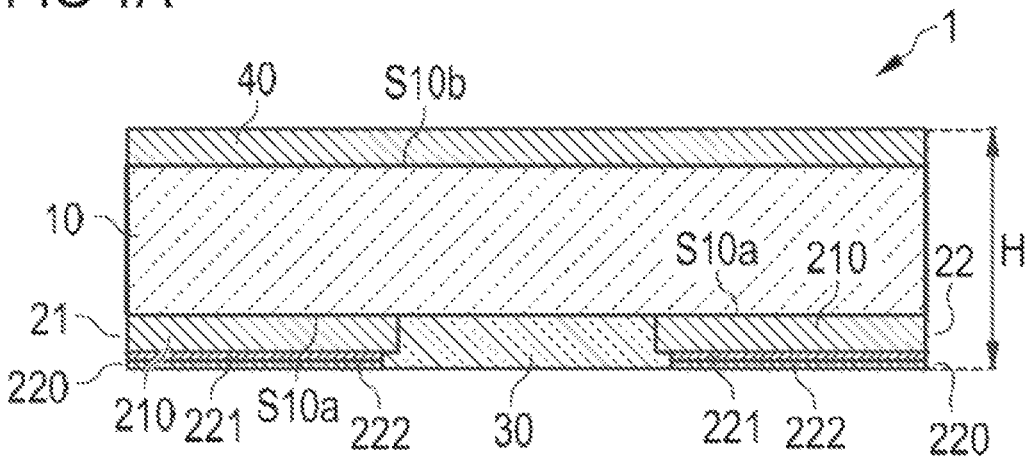

(51) Int. Cl.

| | |
|---|---|
| ***H01C 7/00*** | (2006.01) |
| ***H01C 7/04*** | (2006.01) |
| ***H01C 7/18*** | (2006.01) |
| ***H01C 7/12*** | (2006.01) |
| ***H01C 17/00*** | (2006.01) |

(56) References Cited

U.S. PATENT DOCUMENTS

| | | | | |
|---|---|---|---|---|
| 6,184,772 | B1 * | 2/2001 | Kawase et al. | 338/22 R |
| 6,385,034 | B2 * | 5/2002 | Tanaka | 361/306.3 |
| 2008/0238604 | A1 | 10/2008 | Sato et al. | |
| 2013/0221584 | A1 * | 8/2013 | Miura | 264/618 |
| 2013/0222106 | A1 * | 8/2013 | Saito et al. | 338/22 R |
| 2013/0328153 | A1 * | 12/2013 | Miura | 257/467 |

FOREIGN PATENT DOCUMENTS

| | | | |
|---|---|---|---|
| JP | 06-302406 | A | 10/1994 |
| JP | H10149901 | A | 6/1998 |
| JP | H10508430 | | 8/1998 |
| JP | H10335114 | | 12/1998 |
| JP | H11054301 | A | 2/1999 |
| JP | H11283803 | | 10/1999 |
| JP | 2006173159 | A | 6/2006 |
| WO | 2011/024724 | A1 | 3/2011 |

* cited by examiner

METHOD FOR PRODUCING AN ELECTRICAL COMPONENT, AND ELECTRICAL COMPONENT

The invention relates to a method for producing an electrical component, which can be used for example for protection against electrostatic discharge or as a sensor, and to an electrical component produced by the method.

Electronic circuits, which are generally operated at low supply and signal voltages, can be destroyed when a high voltage, for example an electrostatic overvoltage, occurs at the voltage-feeding contact connections. In order to protect the sensitive circuit components against such an electrical overvoltage, protective components for protection against electrostatic discharge can be connected to the voltage-feeding contact connections, by means of which high electrostatic voltages can be dissipated to a reference potential, for example an earth potential.

By way of example, multilayer varistors in SMD (surface mounted device) technology can be used as protective circuits against electrostatic discharge. For purposes of integration into a printed circuit board or into an LED (light emitting diode) housing, ESD (electrostatic discharge) protective components that are as thin as possible are required. With regard to the component height or layer thickness, however, the production of SMD multilayer varistors has hitherto encountered production engineering limits.

It is desirable to specify a method for producing an electrical component which can be used to produce a component having a very small component height. Furthermore, the intention is to specify an electrical component produced by the method.

A method for producing an electrical component comprises providing a ceramic semiconducting base body having a surface and a first side area lying opposite the surface, wherein a metallic layer is contained within the base body. At least two further metallic layers are arranged separately from one another on the side area of the base body. The arrangement composed of the base body and the further metallic layers is sintered. An electrically insulating layer is arranged on the first side area of the base body between the at least two further metallic layers as a passivation layer. A respective contact layer is arranged on the at least two further metallic layers by means of a chemical process. In this case, the material of the base body is removed by the chemical process proceeding from the surface of the base body at most as far as the metallic layer arranged within the base body.

Consequently, the material of the base body which is arranged above the metallic layer contained within the base body constitutes a sacrificial layer which is already undercut during the chemical operation of applying the contact layers by the acids/bases involved in the chemical process. At the same time, at the unpassivated regions of the first side area, which are not covered by the metallic layer applied on the first side area and the electrically insulating layer, trenches are etched into the material of the base body. By way of example, electroless plating, for example ENIG (electroless nickel immersion gold), ENEPIG (electroless nickel, electroless palladium immersion gold), or electroplating, wherein the electrolyte can be a caustic acid or base, can be used as a chemical process for applying the contact layer.

During a subsequent etching process, in order to singulate a component from the base body, the trench can be etched further and the sacrificial layer can be removed as far as the metallic layer arranged within the base body. The metallic layer within the base body acts as an etching stop layer, such that the underlying material of the base body is not etched further. Since the metallic layer arranged within the material of the base body can be introduced into the material of the base body near the first side area of the base body, the method makes it possible to produce a component having a small structural height.

The electrically insulating layer between the contacts is a passivation layer, which prevents the material of the base body that is arranged below the electrically insulating layer from being etched during the chemical process or during the etching process for singulating the component. The passivation layer arranged between the contacts can comprise, for example, a material which contains glass, silicon nitride ($Si_3N_4$), silicon carbide (SiC), aluminium oxide ($Al_2O_3$) or a polymer. The contact layer can be embodied as an individual layer composed of silver, for example. As an alternative thereto, the contact layer can also contain a plurality of partial layers, for example different metal sequences, such as, for example nickel, palladium, gold or tin.

The specified embodiment of the method for producing an electrical component makes it possible, in particular, to realize ESD protective components or ceramic sensors having component heights between a metallic layer acting as an electrode and the contact layers of less than 150 μm and typically of approximately 50 μm. In this case, the electrical component can be produced cost-effectively and used for the manufacture of ultrathin individual chips and also for arrays.

An electrical component produced by the method comprises a ceramic semiconducting base body having a first side area, on which at least two contacts spaced apart from one another are arranged, and a second side area, which lies opposite the first side area and on which a metallic layer is arranged. Each of the contacts has a further metallic layer, which is arranged on the first side area of the base body, and a contact layer, which is arranged on the further metallic layer. An electrically insulating layer is arranged between the at least two contacts, the at least two contacts being electrically insulated from one another by said electrically insulating layer. The electrical component between the metallic layer and the respective contact layer of the contacts has a component height of at most 150 μm and preferably of 50 μm.

Figure 1B:
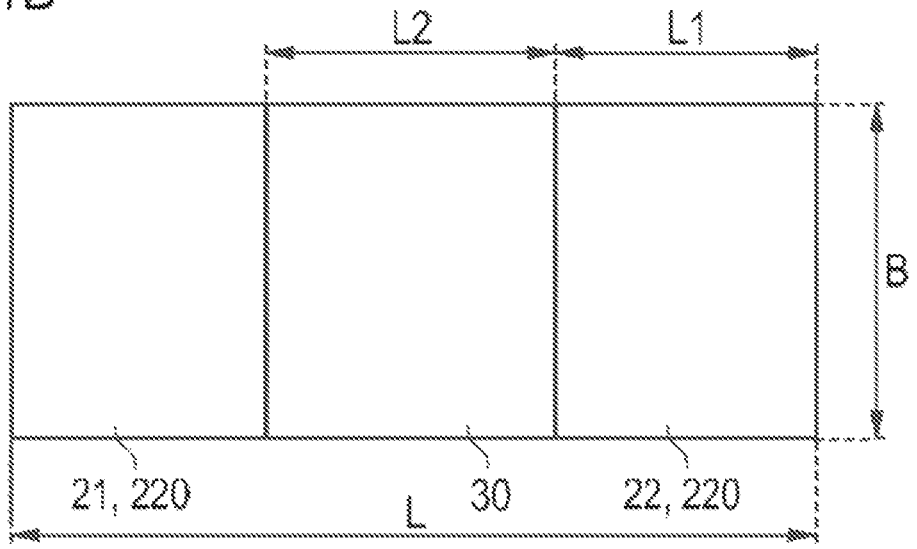
Figure 2A:
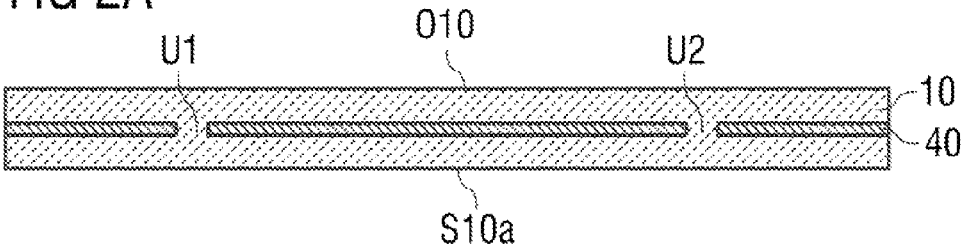
Figure 2B:
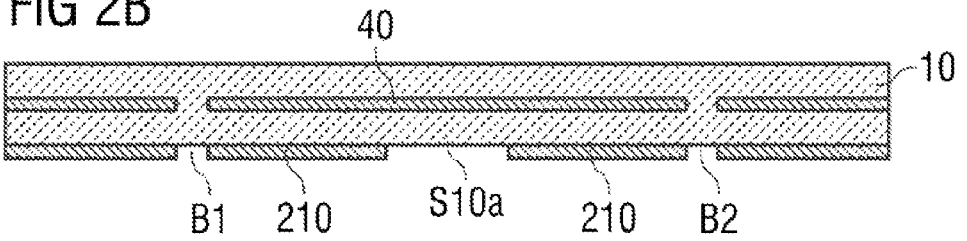
Figure 2C:
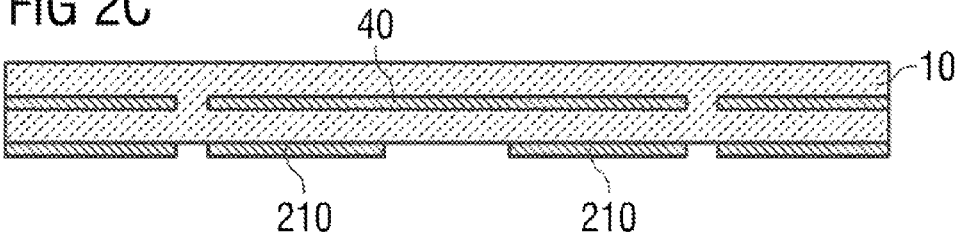
Figure 2D:
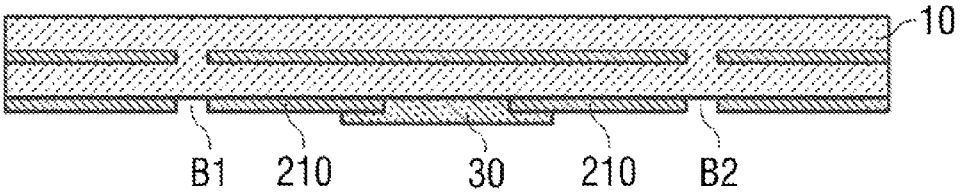
Figure 2E:
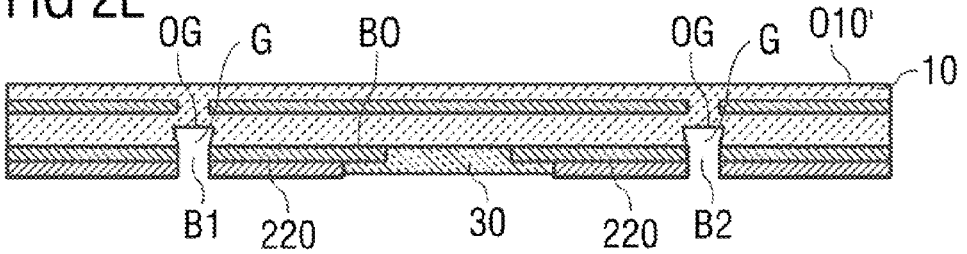
Figure 2F:
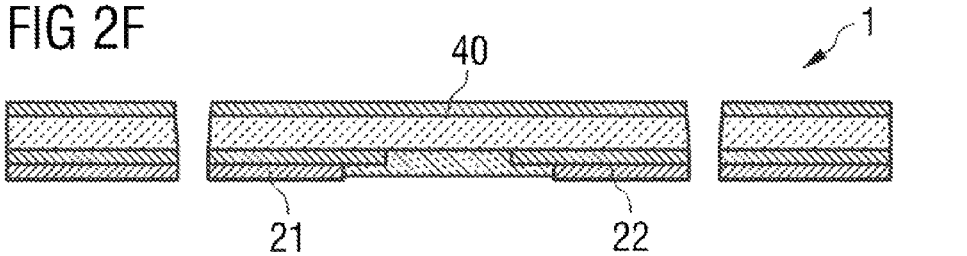
Figure 3A:
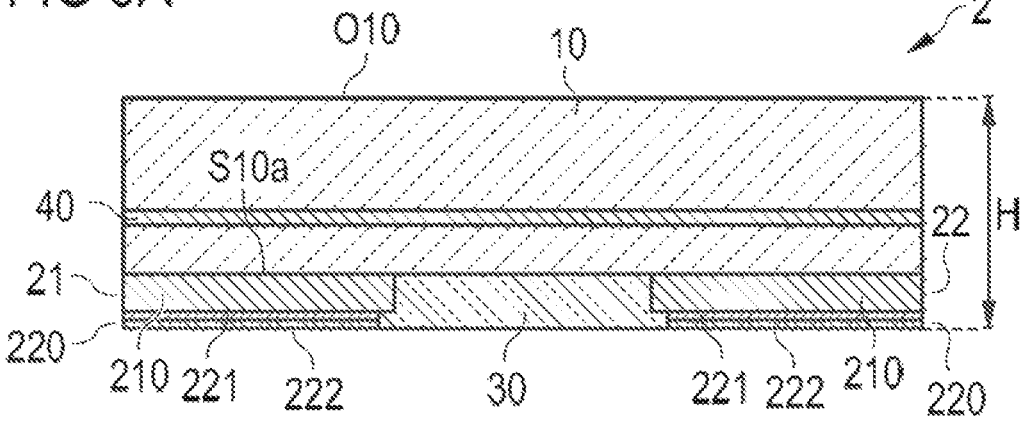
Figure 3B:
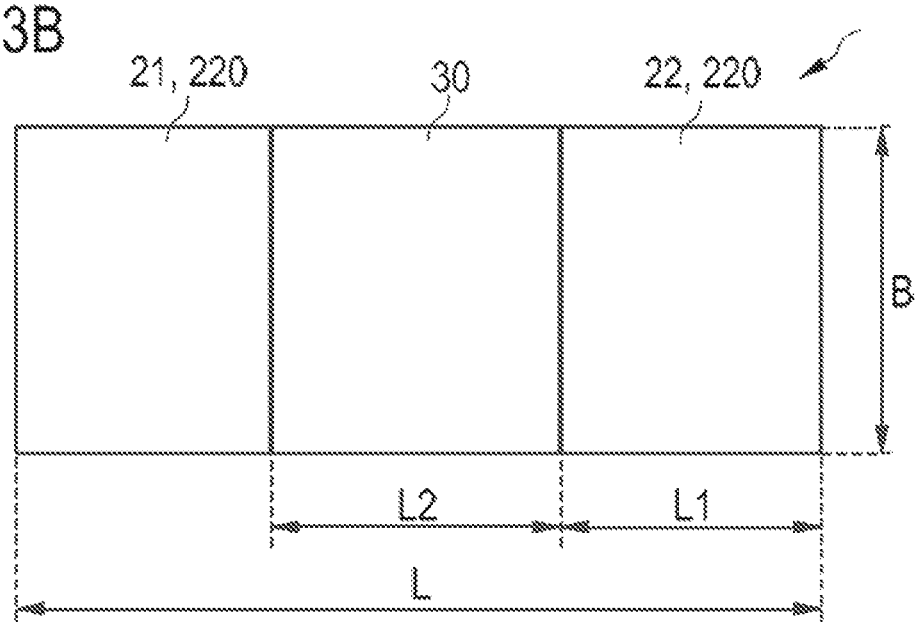
Figure 4A:
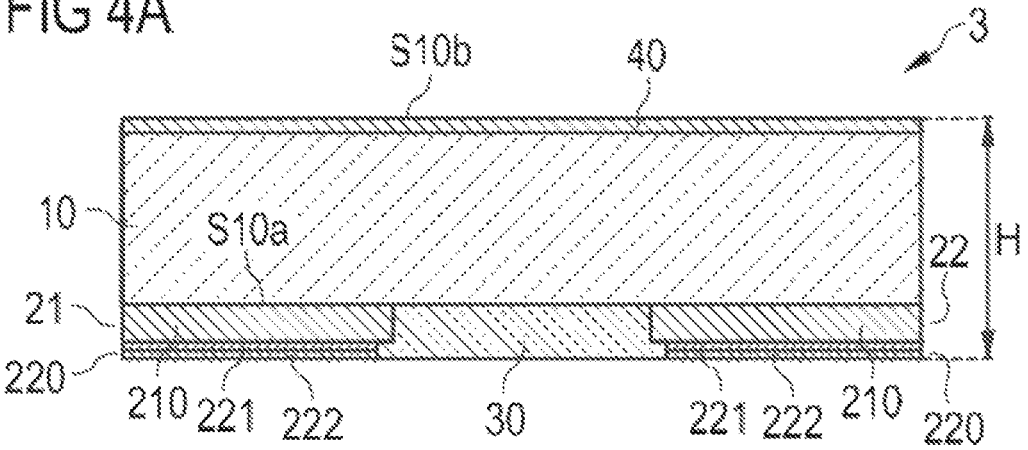
Figure 4B:
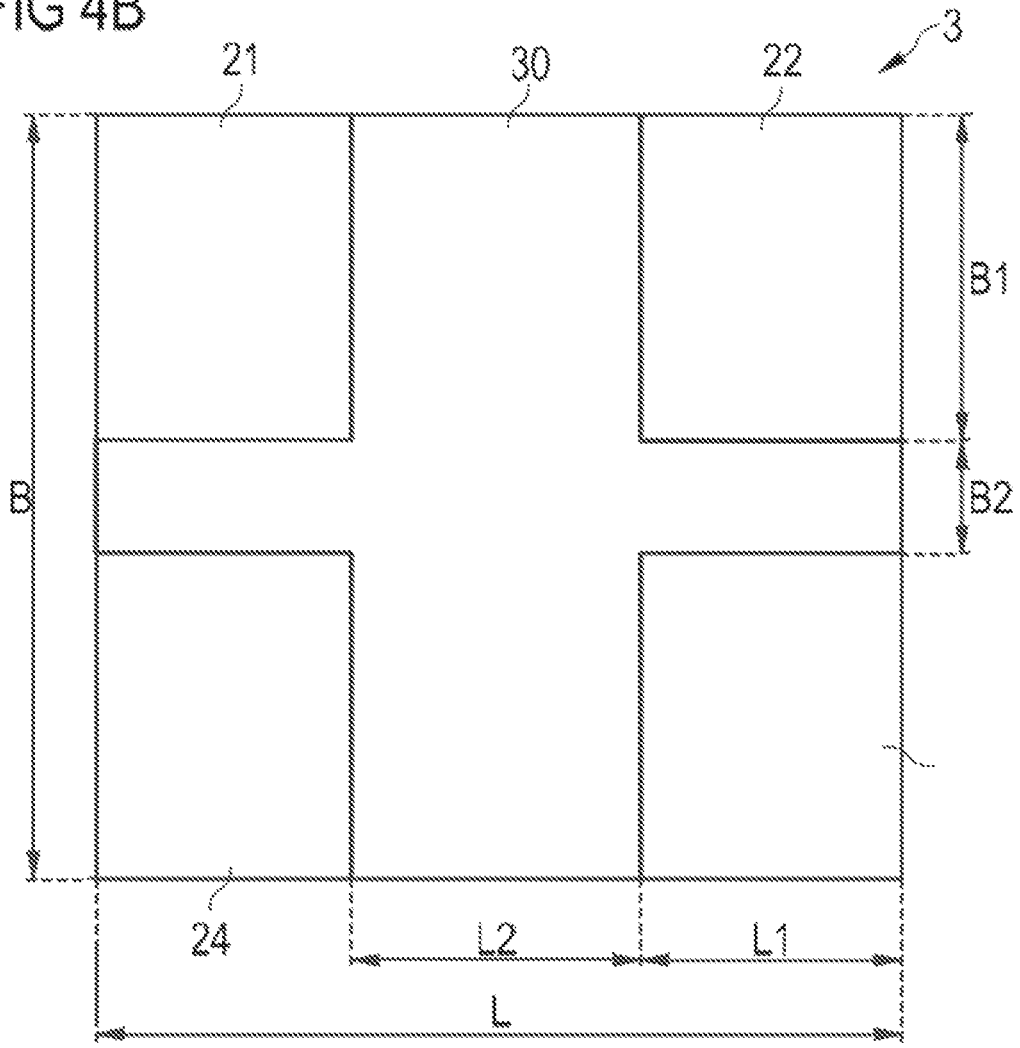
Figure 5A:
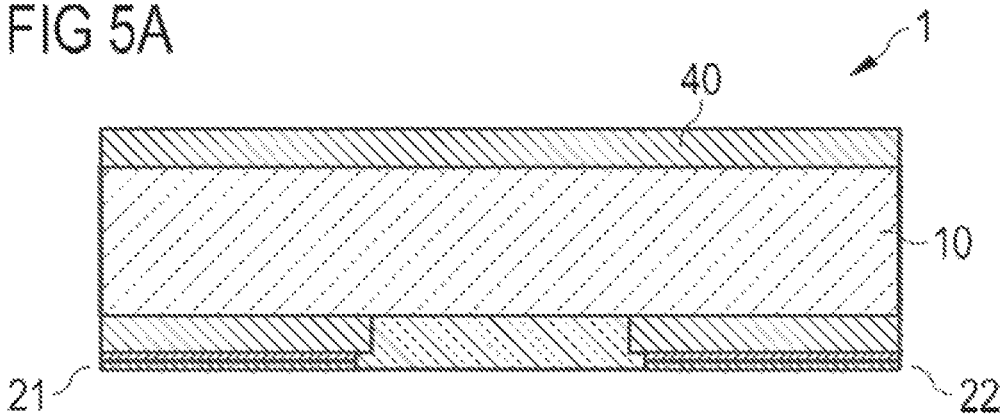
Figure 5B:
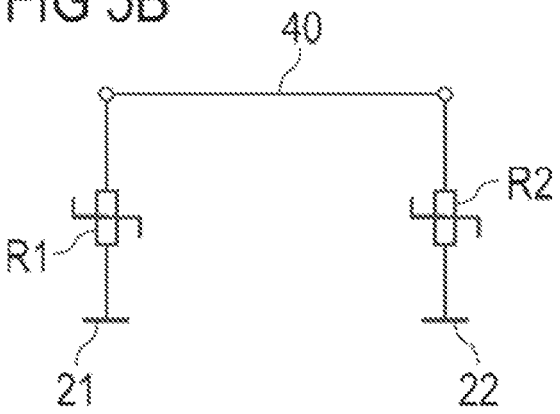
Figure 5C:
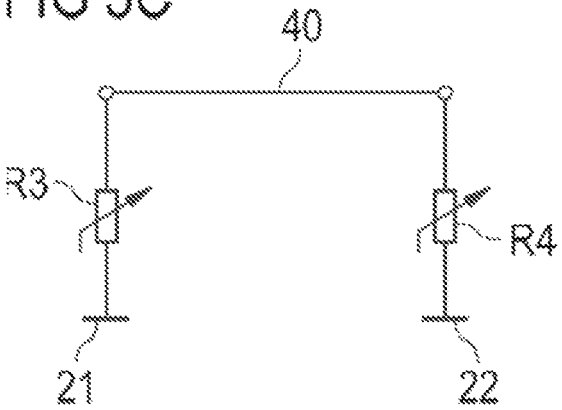

Embodiments of the method for producing the electrical component and embodiments of electrical components that can be produced by the method are explained by way of example below with reference to the figures, in which:

FIG. 1A shows a transverse view of one embodiment of an electrical component, FIG. 1B shows a plan view of the embodiment of the electrical component, FIG. 2A shows one manufacturing step of one embodiment of a method for producing an electrical component, FIG. 2B shows a further manufacturing step of the embodiment of the method for producing the electrical component, FIG. 2C shows a further manufacturing step of the embodiment of the method for producing the electrical component, FIG. 2D shows a further manufacturing step of the embodiment of the method for producing the electrical component, FIG. 2E shows a further manufacturing step of the embodiment of the method for producing the electrical component, FIG. 2F shows a further manufacturing step of the embodiment of the method for producing the electrical component, FIG. 3A shows a transverse view of a further embodiment of an electrical component, FIG. 3B shows a plan view of the further embodiment of the electrical component, FIG. 4A shows a transverse view of a further embodiment of the electrical component, FIG. 4B shows a plan view of a further embodiment of an electrical component, FIG. 5A shows one embodiment of an electrical component for protection against electrostatic discharge or as a ceramic sensor, FIG. 5B shows an equivalent circuit of an embodiment of an electrical component for protection against electrostatic discharge, FIG. 5C shows an equivalent circuit of an embodiment of an electrical component as a ceramic sensor.

FIG. 1A shows an embodiment 1 of an electrical component which can be used, for example, for protection against electrostatic discharge or as a sensor. The electrical component comprises a ceramic semiconducting base body 10. The base body 10 has a side area S10*a* and a side area S10*b* lying opposite the side area S10*a*. A metallic layer 40 is arranged in the material of the base body between the side areas S10*a* and S10*b*. The metallic layer 40 can contain silver, for example. At least two contacts 21 and 22 spaced apart from one another are arranged on the side area S10*a*. The contacts 21 and 22 in each case have a metallic layer 210 and a contact layer 220. The metallic layer 210 of the contact 21 and of the contact 22 are arranged at a distance from one another in each case on the side area S10*a* of the base body 10. The contact layers 220 of the contacts 21 and 22 are arranged in each case on the metallic layer 210.

The metallic layer 210 of the contacts 21 and 22 can contain silver, for example. The contact layer 220 can comprise, for example, a material composed of nickel and/or gold. By way of example, the respective contact layer 220 of the contacts 21 and 22 can have a partial layer 221 and a partial layer 222. The partial layer 221 can be arranged on the metallic layer 210 and the partial layer 222 can be arranged on the partial layer 221. The partial layer 221 can comprise a material composed of nickel, for example, and the partial layer 222 can comprise a material composed of gold, for example.

An electrically insulating layer 30 is arranged between the contacts 21 and 22 on the side area S10*a* of the base body 10. The electrically insulating layer 30 is embodied in such a way that it isolates both the metallic layer 210 of the contact connections 21 and 22 and the contact layers 220 of the two contacts 21 and 22 from one another. Consequently, the two contacts 21 and 22 are electrically insulated from one another by the layer 30. The electrically insulating layer 30 can contain a material composed of glass, for example.

FIG. 1B shows a plan view of the embodiment 1 of the electrical component shown in FIG. 1A. The illustration shows the contacts 21 and 22, in particular the respective contact layer 220 of the contacts 21 and 22, which are separated from one another and thereby electrically insulated from one another by the electrically insulating layer 30.

In the case of the embodiment 1 shown in FIGS. 1A and 1B, the electrical component between the metallic layer 40 and the contact areas 220 can have a component height H of 50 μm. The width B of the component can be 100 μm, for example, and the length L can be 250 μm. In this case, the contact layers 220 can each have a length L1 of 50 μm and the electrically insulating layer 30 can have a length L2 of 150 μm.

FIGS. 2A to 2F show one embodiment of a production method for producing an electrical component which can be used, for example, for protection against electrostatic discharge or as a sensor. A ceramic semiconducting base body 10 having a surface O10 and a side area S10*a* lying opposite the surface O10 is provided, wherein a metallic layer 40 is contained within the base body. The metallic layer 40 arranged within the base body 10 can be interrupted at at least two locations U1, U2. The sections of the metallic layer 40 which are arranged on both sides of the locations U1 and U2 belong to other components. The metallic layer 40 is arranged approximately parallel to the surface O10 and respectively the side area S10*a* of the base body in the interior of the base body. The base body 10 with the metallic layer 40 contained therein can be embodied as a wafer. The first manufacturing step of the production method as shown in FIG. 2A involves laminating, stacking and pressing the base body 10.

A further manufacturing step, illustrated in FIG. 2B, involves structuring the wafer or base body 10 at the side area S10*a* with at least two metallic layers 210 which respectively form a part of the contacts 21 and 22 of the electrical component. In this case, the metallic layers 210 are arranged at a distance separately from one another on the side area S10*a* of the base body. For this purpose, by way of example, a thin layer composed of a material composed of silver can be applied to sections of the side area S10*a* which are spaced apart from one another. The at least two metallic layers 210 are arranged on the side area S10*a* of the base body 10 in such a way that a region B1 and a region B2 of the side area S10*a* of the base body 10 are not covered by the at least two further metallic layers. The regions B1 and B2 are arranged below the locations U1 and U2 in projection. Metallic layers 210 belonging to other components are arranged alongside the regions B1 and B2. The metallic layers 210 form a passivation layer for the underlying material of the base body.

A further manufacturing step, shown in FIG. 2C, involves sintering the arrangement composed of the base body 10 with the structured metallic layers 210 applied thereon.

FIG. 2D shows a further manufacturing step, which comprises applying a passivation to a section of the side area S10*a* between the metallic layers 210. As passivation layer, an electrically insulating layer 30, for example composed of a material composed of glass, can be applied between the metallic layers 210 of the contacts 21 and 22. The electrically insulating layer 30 can be arranged directly on a section of the side area S10*a* of the base body 10 between the spaced-apart metallic layers 210. In this case, the passivation layer 30 can also be applied to partial sections of the metallic layer 210. The regions B1 and B2 furthermore continue not to be covered by a passivation.

In the further manufacturing step shown in FIG. 2E, the contacts 21 and 22 are completed by the contact layers 220 respectively being applied to the metallic layers 210. For this purpose, a material comprising nickel and/or gold, for example, can be applied on the metallic layer 210. By way of example, on each of the metallic layers 210, firstly a partial layer 221 containing nickel can be applied and a partial layer 222 containing gold can subsequently be applied to the partial layer 221. The contact layer 220 can be applied to the metallic layers 210 in electroless fashion by a chemical process.

By means of the chemical process for applying the contact layers 220, in which acids and/or bases are involved, the material of the base body is etched at the non-passivated regions B1 and B2 during the application of the contact layers 220. In this case, proceeding from the non-passivated regions B1, B2 at the side area S10*a* of the base body, a trench G is etched into the base body. The etching is effected anisotropically, for example. By means of the chemical process of applying the contact layers 210, the material of the base body is removed as far as a surface OG of the trench. The material of the base body 10 can be removed at the regions B1 and B2 to an extent such that the surface of the trench lies between the metallic layer 210 and the metallic layer 40. Below a region B0 of the side area S10*a* which is covered by the metallic layers 210 acting as passivation layers and the electrically insulating layer 30, the etching of the material of the base body is prevented.

Furthermore, the material of the base body is also etched at the non-passivated surface O10 in the direction of the metallic layer 40. The material of the base body that is present between the surface O10 and the metallic layer 40 constitutes a sacrificial layer that is removed during the chemical process of applying the contact layers proceeding from the surface O10 as far as a surface O10'. If the region between the original surface O10 and the metallic layer 40 represents the initial thickness of the sacrificial layer, the surface O10' of the sacrificial layer can lie between the original surface O10 of the sacrificial layer and the metallic layer 40 after the action of the chemical process for applying the contact areas 220. Consequently, the layer thickness of the base body above the metallic layer 40 decreases further during the chemical process for applying the contact layer 220.

FIG. 2F shows the singulation of the electrical component 1 from the wafer 10 as a further manufacturing step. For this purpose, in a further etching process, which is effected anisotropically, for example, the trenches already formed during the chemical process of applying the contact areas 220 can be etched further at the regions B1 and B2 until the material of the base body has been completely removed below the interruptions U1 and U2 of the metallic layer 40. Proceeding from the surface OG of the trench pre-etched during the chemical process, the material of the base body can now be removed at least as far as the metallic layer 40. Furthermore, the material of the ceramic semiconducting base body which is still present above the metallic layer 40 and which forms the sacrificial layer can be etched away as far as the metallic layer 40. The metallic layer 40 acts as an etching stop layer, such that the underlying material of the base body is not etched further. Consequently, the components can be singulated from the wafer assemblage. Besides etching, the singulation can alternatively be effected by breaking the individual components from the wafer assemblage.

FIG. 3A shows a further embodiment 2 of the electrical component, which can be used for example for protection against electrostatic discharge or as a sensor, in a transverse view. The electrostatic component comprises a ceramic semiconducting base body 10 having a surface O10 and a side area S10*a* lying opposite the surface O10. A metallic layer 40 is provided within the material of the ceramic semiconducting base body 10. The metallic layer 40 can comprise, for example, a material composed of silver. At least two contacts 21 and 22 are arranged in a manner spaced apart from one another on the side area S10*a* of the ceramic semiconducting base body 10. Each of the contacts 21 and 22 comprises a metallic layer 210 and a contact layer 220. The metallic layer 210 of the respective contact is arranged directly on the side area S10*a* of the base body and can contain, for example, a material composed of silver.

The respective contact layer 220 of each of the contacts is arranged on the respective metallic layer 210. The contact layer 220 can comprise, for example, a material composed of nickel and/or gold. The contact layer 220 can have, for example, a partial layer 221 arranged on the metallic layer 210 of the respective contact. A further partial layer 222 of the contact layer 220 can be arranged on the partial layer 221. The partial layer 221 can contain, for example, a material composed of nickel and the partial layer 222 can contain a material composed of gold.

An electrically insulating layer 30 is provided as passivation between the contacts 21 and 22, as in the case of the variant of the electrical component shown in FIGS. 1A and 1B. The electrically insulating layer 30 can be arranged on a section of the side area S10*a* between the metallic layers 210. The passivation layer 30 is embodied in such a way that both the metallic layer 210 and the contact layer 220 of the respective contacts 21 and 22 are electrically insulated from one another.

FIG. 3B shows a plan view of the embodiment of the electrical component 2 shown in FIG. 3A. Arranged on the underside of the electrical component are the contacts 21 and 22, in particular the contact layers 220 of the respective contacts 21 and 22, which are electrically insulated from one another by the electrically insulating layer 30.

The electrical component 2 shown in FIGS. 3A and 3B can be realized, for example, with a component height H of 50 μm measured between the surface O10 and the contact layers 220. The width B of the component can be 100 μm and the length L can be 250 μm. In this case, the contacts 21 and 22 can in each case have a length L1 of 50 μm and the electrically insulating layer 30 can have a length L2 of 150 μm. The component in accordance with the embodiment 2 can be produced, for example, by a procedure in which, in the last manufacturing step in FIG. 2E, the sacrificial layer of the base body 10, said sacrificial layer being arranged above the metallic layer 40, is not removed completely as far as the metallic layer 40.

FIG. 4A shows a further embodiment 3 of the electrical component, which can be used, for example, for protection against electrostatic discharge or as a sensor, in a transverse view. In a similar manner to the embodiment shown in FIG. 1, the electrical component comprises a ceramic semiconducting base body 10. At least two contacts are arranged in a manner spaced apart from one another on a side area S10*a* of the base body 10. In the exemplary embodiment shown in FIG. 4A, the electrical component is embodied as an array having more than two contacts. The component can have, for example, four contacts 21, 22, 23 and 24. Only the contacts 21 and 22 are visible in the transverse view shown in FIG. 4A.

Each of the contacts 21 and 22 comprises a metallic layer 210, for example a layer composed of silver, which are arranged in a manner spaced apart from one another on the side area S10*a*. Furthermore, the contacts in each case have a contact layer 220 arranged on the respective metallic layer 210 of the contacts. The contact layer 220 can comprise a material composed of nickel and/or gold. The contact layer 220 can have, for example, a partial layer 221 and a partial layer 222. The partial layer 221 is arranged directly on the metallic layer 210 of the respective contact. The partial layer 222 is arranged on the partial layer 221 of the respective contact. The partial layer 221 can contain, for example, a material composed of nickel and the partial layer 222 can contain a material composed of gold.

An electrically insulating layer 30 is arranged between the two contacts 21 and 22, the contacts 21 and 22 and thus the respective metallic layer 210 and the respective contact layer 220 of the contacts being electrically insulated from one another by said electrically insulating layer. The electrically insulating layer 30 can be arranged, for example, directly on a section of the side area S10*a* of the base body 10 between the metallic layers 210. The electrically insulating layer constitutes a passivation layer and can comprise a material composed of glass, for example.

FIG. 4B shows the embodiment 3 of the electrical component as shown in FIG. 4A in a plan view of the contacts 21, 22, 23 and 24 and the electrically insulating layer 30. As illustrated in FIG. 4B, the contacts 21, 22, 23 and 24 are isolated from one another at high impedance or electrically insulated from one another by the electrically insulating layer 30 arranged between them.

In the case of the embodiment shown in FIGS. 4A and 4B, the electrical component 3 between the metallic layer 40 and the contact areas 220 can have a component height H of 50 μm. In contrast to the embodiments 1 and 2 of the electrical component the embodiment 3 of the electrical component has a square base area. The electrical component can have, for example, a width B and a length L of 250 μm. In this case, the contacts can each have a width B1 of 100 μm and the electrically insulating layer can have a width B2 of 50 μm. The contacts can each have a length L1 of 50 μm and the electrically insulating layer can have a length L2 of 150 μm.

FIG. 5A shows the embodiment 1 of the electrical component in the form of a passivated ceramic chip comprising the base body 10, the contacts 21 and 22, the electrically insulating layer 30 arranged therebetween and the further metallic layer 40. With a structure of this type, it is possible to realize, for example, an ESD component with a multilayer varistor or a component with a multilayer NTC (negative temperature coefficient) thermistor, which component can be used as a sensor.

FIG. 5B shows a realization of the component as a varistor, such that the component can be used, for example, as an ESD protective component. In the embodiment as a multilayer varistor, the base body 10 of the component contains, for example, a material composed of zinc oxide and praseodymium, for example ZnO(Pr). By way of example, zinc oxide doped with praseodymium can be provided as material of the base body 10. As an alternative thereto, a material composed of zinc oxide and bismuth, for example ZnO(Bi), can also be used. The contacts 21 and 22 form a respective connection for applying a reference potential, for example the earth potential. Besides the function as an etching stop layer during production, the metallic layer 40 has the function of a current-carrying electrode in later operation of the component. Between the current-carrying electrode 40 and the contact 21, the ceramic semiconducting base body forms a voltage-dependent resistor R1. Between the current-carrying electrode in the form of the metallic layer 40 and the contact 22, the ceramic semiconducting base body 10 forms a further voltage-dependent resistor R2.

FIG. 5C shows an equivalent circuit diagram of the component if a material having a negative temperature coefficient, for example an NTC material, is used as material of the base body. In this case, the component can be used as a ceramic sensor. The base body 10 forms a respective temperature-dependent resistor R3 and R4 between the contacts 21 and 22 and the metallic layer 40. The contacts 21 and 22 can be used as connections for applying a reference potential, for example the earth potential. The metallic layer 40 has the function of a current-carrying electrode during the operation of the component. Between the metallic layer 40 and the contact 21, the ceramic semiconducting base body 10 forms the temperature-dependent resistor R3. Between the metallic layer 40 and the contact 22, the ceramic semiconducting base body 10 forms the further temperature-dependent resistor R4.

LIST OF REFERENCE SIGNS

1, 2, 3 Embodiments of the electrical component
10 Ceramic semiconducting base body
21, 22 Contacts
30 Electrically insulating layer
40 Metallic layer
210 Metallic layer
220 Contact layer
221, 222 Partial layers of the contact layer
R1, R2 Voltage-dependent resistors
R3, R4 Temperature-dependent resistors

The invention claimed is:

1. A method for producing an electrical component, comprising:

providing a ceramic semiconducting base body (10) having a surface (O10) and a first side area (S10*a*) lying opposite the surface (O10), wherein a metallic layer (40) is contained within the base body, arranging at least two further metallic layers (210) separately from one another on the side area (S10*a*) of the base body, sintering the arrangement composed of the base body (10) and the further metallic layers (210), arranging an electrically insulating layer (30) on the first side area (S10*a*) between the at least two further metallic layers (210), arranging a respective contact layer (220) on the at least two further metallic layers (210) by means of a chemical process, wherein the material of the base body (10) is removed by the chemical process proceeding from the surface (O10) of the base body (10) at most as far as the metallic layer (40) arranged within the base body.

2. The method according to claim 1, wherein the metallic layer (40) arranged within the base body (10) is interrupted at least two locations (U1, U2), wherein the at least two further metallic layers (210) are arranged on the first side area (S10*a*) of the base body (10) in such a way that a first and second region (B1, B2) of the first side area (S10*a*) of the base body are not covered by the at least two further metallic layers (210), wherein the material of the base body (10) is etched at the regions (B1, B2) of the first side area (S10*a*) of the base body (10) by the chemical process.

3. The method according to claim 2, wherein the electrical component (1, 2, 3) is singulated from the material of the base body (10) by an etching process succeeding the chemical process.

4. The method according to any of claims 1 to 3, wherein the material of the base body is prevented from being etched at a region (B0) of the base body (10) which is covered by the at least two further metallic layers (210) and by the electrically insulating layer (30).

5. The method according to claim 4, wherein the metallic layer (40) is arranged within the base body in such a way that the electrical component (1, 2, 3) between the metallic layer (40) arranged within the base body (10) and the contact layers (220) has a thickness of at most 150 μm and preferably of 50 μm.

6. The method according to claim 1, wherein the ceramic semiconducting base body (10) contains a material composed of zinc oxide and praseodymium or a material having a negative temperature coefficient.

7. The method according to claim 1, wherein the electrically insulating layer (30) contains a material composed of glass or silicon nitride or silicon carbide or aluminium oxide or a polymer and the metallic layer (40) and the further metallic layers (210) contain a material composed of silver.

8. The method according to claim 1, wherein the contact layer (220) contains a material composed of nickel and/or gold and/or palladium and/or tin and/or silver.

9. An electrical component, comprising:

a ceramic semiconducting base body (10) having a first side area (S10*a*), on which at least two contacts (21, 22) spaced apart from one another are arranged, and a second side area (S10*b*), which lies opposite the first side area (S10*a*) and on which a metallic layer (40) is arranged, wherein each of the contacts (21, 22) has a further metallic layer (210), which is arranged on the first side area (S10*a*) of the base body, and a contact layer (220), which is arranged on the further metallic layer (210), wherein an electrically insulating layer (30) is arranged between the at least two contacts (21, 22), the at least two contacts (21, 22) being electrically insulated from one another by said electrically insulating layer, wherein the electrical component between the metallic layer (40) and the respective contact layer (210) of the contacts (21, 22) has a component height (H) of at most 150 μm and preferably of 50 μm, and wherein the metallic layer (40) is thinner than the ceramic semiconducting base body (10).

10. An electrical component, comprising:

a ceramic semiconducting base body (10) having a surface (O10) and a first side area (S10*a*), which lies opposite the surface (O10) and on which at least two contacts (21, 22) spaced apart from one another are arranged, wherein a metallic layer (40) is arranged within the base body (10), wherein each of the contacts (21, 22) has a further metallic layer (210), which is arranged on the first side area (S10*a*) of the base body, and a contact layer (220), which is arranged on the further metallic layer (210), wherein an electrically insulating layer (30) is arranged between the at least two contacts (21, 22), the at least two contacts (21, 22) being electrically insulated from one another by said electrically insulating layer, wherein the electrical component between the surface (O10) and the respective contact layer (210) of the contacts (21, 22) has a component height (H) of at most 150 μm and preferably of 50 μm.

11. The electrical component according to claim 9 or 10, wherein the ceramic semiconducting base body (10) contains a material composed of zinc oxide and praseodymium or a material having a negative temperature coefficient.

12. The electrical component according to claim 9 or 10, wherein the electrically insulating layer (30) is arranged on the first side area (S10*a*) of the base body (10).

13. The electrical component according to claim 9 or 10, wherein the electrically insulating layer (30) contains a material composed of glass or silicon nitride or silicon carbide or aluminium oxide or a polymer.

14. The electrical component according to claim 9 or 10, wherein at least one of the metallic and of the further metallic layers (40, 210) contains a material composed of silver.

15. The electrical component according to claim 9 or 10, wherein the contact layer (220) contains a material composed of nickel and/or gold and/or palladium and/or tin and/or silver.

* * * * *